US009987729B2

(12) United States Patent
Botten

(10) Patent No.: US 9,987,729 B2
(45) Date of Patent: Jun. 5, 2018

(54) BAR CLAMP WITH WORKPIECE STABILIZATION

(71) Applicant: Peter Botten, Lakewood, OH (US)

(72) Inventor: Peter Botten, Lakewood, OH (US)

( * ) Notice: Subject to any disclaimer, the term of this patent is extended or adjusted under 35 U.S.C. 154(b) by 70 days.

(21) Appl. No.: 14/626,998

(22) Filed: Feb. 20, 2015

(65) Prior Publication Data

US 2016/0243675 A1 Aug. 25, 2016

(51) Int. Cl.
*B25B 3/00* (2006.01)
*B25B 5/14* (2006.01)
*B25B 5/10* (2006.01)

(52) U.S. Cl.
CPC ..... *B25B 5/145* (2013.01); *B25B 5/102* (2013.01)

(58) Field of Classification Search
USPC ..... 269/151
See application file for complete search history.

(56) References Cited

U.S. PATENT DOCUMENTS 1,187,109 A * 6/1916 Steuernagel ..... B25B 5/166 24/134 R
4,244,253 A * 1/1981 Flanigan ..... B23D 59/00 144/135.2
4,552,345 A * 11/1985 Benda ..... B25B 5/003 269/113
5,058,870 A * 10/1991 Cetnar ..... B25B 5/145 269/118
5,342,031 A * 8/1994 Yu-Fang ..... B25B 5/10 269/113
5,987,736 A * 11/1999 Copp ..... B32B 37/18 29/33 R
6,554,264 B1 * 4/2003 Alford ..... B25B 1/103 269/147
7,798,478 B2 9/2010 Janson
7,909,315 B2 * 3/2011 Hill ..... B25B 5/145 269/104
8,505,892 B2 * 8/2013 Seidel ..... B25B 5/003 269/249
2003/0075851 A1 * 4/2003 Alford ..... B25B 1/103 269/147
2003/0141644 A1 * 7/2003 Thomas ..... B25B 5/163 269/6
2010/0327504 A1 * 12/2010 Seidel ..... B25B 5/003 269/43
2013/0140750 A1 * 6/2013 Allred, III ..... B25B 5/067 269/249

* cited by examiner

*Primary Examiner* — Lee D Wilson
(74) *Attorney, Agent, or Firm* — Cooper Legal Group, LLC

(57) ABSTRACT

Provided is a clamp that includes a rail with a track region, a first clamping jaw that is to be maintained at a first clamping location along the rail while a plurality of edge-aligned objects are clamped together. A second clamping jaw is adjustable along the track region of the rail and is to be maintained at a second clamping location along the rail on an opposite side of the plurality of edge-aligned objects from the first clamping jaw. A clamping mechanism urges a face of the second clamping jaw toward the first clamping jaw to impart a compressive force on the plurality of edge-aligned objects. A caul extends between the first and second clamping jaws and exerts a compressive force on the plurality of edge-aligned objects disposed between the caul and the rail.

16 Claims, 7 Drawing Sheets

BAR CLAMP WITH WORKPIECE STABILIZATION

BACKGROUND OF THE INVENTION

1. Field of the Invention

This application relates generally to a bar clamp and, more specifically, to a bar clamp with an integrated caul for promoting uniformly-aligned boards during edge glued together.

2. Description of Related Art

Furniture cases, tabletops and other large pieces of furniture are typically fabricated from wide panels. Early on, old-growth trees having large diameters allowed such panels to be milled as a single piece. But now that most of the old-growth trees have been cut down such trees are becoming increasingly rare, meaning single panels that are suitably-wide to individually form a tabletop or other large piece of furniture are either unavailable or cost prohibitive.

To satisfy the demand for tabletops and other large furniture formed from wide panels, a plurality of relatively-narrow boards are edge glued together in a side-by-side arrangement. Glue or another suitable adhesive is applied to one or both edges of contiguous boards, which are disposed between opposite jaws of a clamp. At least one of the clamp jaws is urged toward the other jaw, thereby tightly pressing the edges of those contiguous boards together while the glue dries. However, many edge-aligned boards may be clamped between the opposing jaws. Under pressure, a rail of a conventional clamp may deflect enough to cause the edge-aligned boards to bow, creating an unwanted arc in the finished assembly. Further, the wet glue or other adhesive applied between the joined edges of the contiguous boards can initially act as a lubricant, possibly allowing the edge-aligned boards to slip relative to each other when subjected to sufficient pressure.

Several attempts have been made to keep edge-aligned boards being glued together in a linear, planar arrangement. One method of keeping such boards in alignment involved gluing sacrificial boards transversely across the edge-aligned boards that are being glued together between the jaws of a clamp to form the tabletop or other wide panel that will form part of the end product. Once the glue has dried, the region of the assembly including the sacrificial boards is cut off and discarded. Such a process, however, is wasteful and time and labor intensive, requiring several additional construction steps to produce the wide panel. Moreover, since wood scraps are often used for the sacrificial boards that will eventually be discarded, the sacrificial boards may not themselves be planar, again allowing the edge-aligned boards to bow.

Another proposed solution to clamping edge-aligned boards involves the use of wall-mounted panel clamps. Such clamps include one rail that is bolted or otherwise coupled to a wall, for example. A jaw attached to this rail supports the edge-aligned boards between the rail affixed to the wall and another, opposing rail that is bolted to the rail affixed to the wall to sandwich the edge-aligned boards. A force can then be applied to urge the edge-aligned boards together while glue between the boards dries. However, such a wall-mounted solution is an expensive, permanent installation that is dedicated solely for the purpose of edge-gluing boards into wide panels. Such wall-mounted solutions also require a large amount of free space to be fixed in place, and are not transportable by hand for use in other types of clamping operations at other locations.

BRIEF SUMMARY OF THE INVENTION

Accordingly, there is a need in the art for a clamp that applies a compressive force to edge-aligned boards and includes an integrated caul that can extend across the edge-aligned boards to maintain the boards in a planar arrangement.

According to one aspect, the subject application involves a clamp that includes a rail comprising a track region. A first clamping jaw cooperates with the rail to be maintained at a first clamping location along a length of the rail while a plurality of edge-aligned objects are clamped together. A second clamping jaw is adjustable along the track region of the rail and cooperates with the rail to be maintained at a second clamping location along the length of the rail to oppose the first clamping jaw while the plurality of edge-aligned objects are clamped together between the first and second clamping jaws. A clamping mechanism is operable to urge a face of the second clamping jaw at the second clamping location toward the first clamping jaw to impart a compressive force on the plurality of edge-aligned objects between the first and second clamping jaws. A caul extends between the first and second clamping jaws and exerts a compressive force on the plurality of edge-aligned objects disposed between the caul and the rail.

According to another aspect, the subject application involves a clamp that includes a rail comprising a top surface that is to make contact with a plurality of edge-aligned objects clamped together, and a track region comprising a plurality of serrations formed along a surface other than the top surface. The top surface, however, can be devoid of the serrations forming the track region. A first clamping jaw is coupled to the rail at a first, stationary clamping location along the rail. A second clamping jaw is adjustable along the track region of the rail and cooperates with the serrations of the track region to maintain a position of the second clamping jaw at a desired location along the rail opposing the first clamping jaw on an opposite side of the plurality of edge-aligned objects. A clamping mechanism is operable to urge a face of the second clamping jaw at the desired location toward the first clamping jaw to impart a compressive force on the plurality of edge-aligned objects between the first and second clamping jaws. A caul spans an entire distance between the first and second clamping jaws and a biasing mechanism is provided to the first and/or second clamping jaw. The biasing mechanism is operable to urge the caul toward the rail and exert a compressive force that promotes a planar arrangement of the plurality of edge-aligned objects disposed between the caul and the rail.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
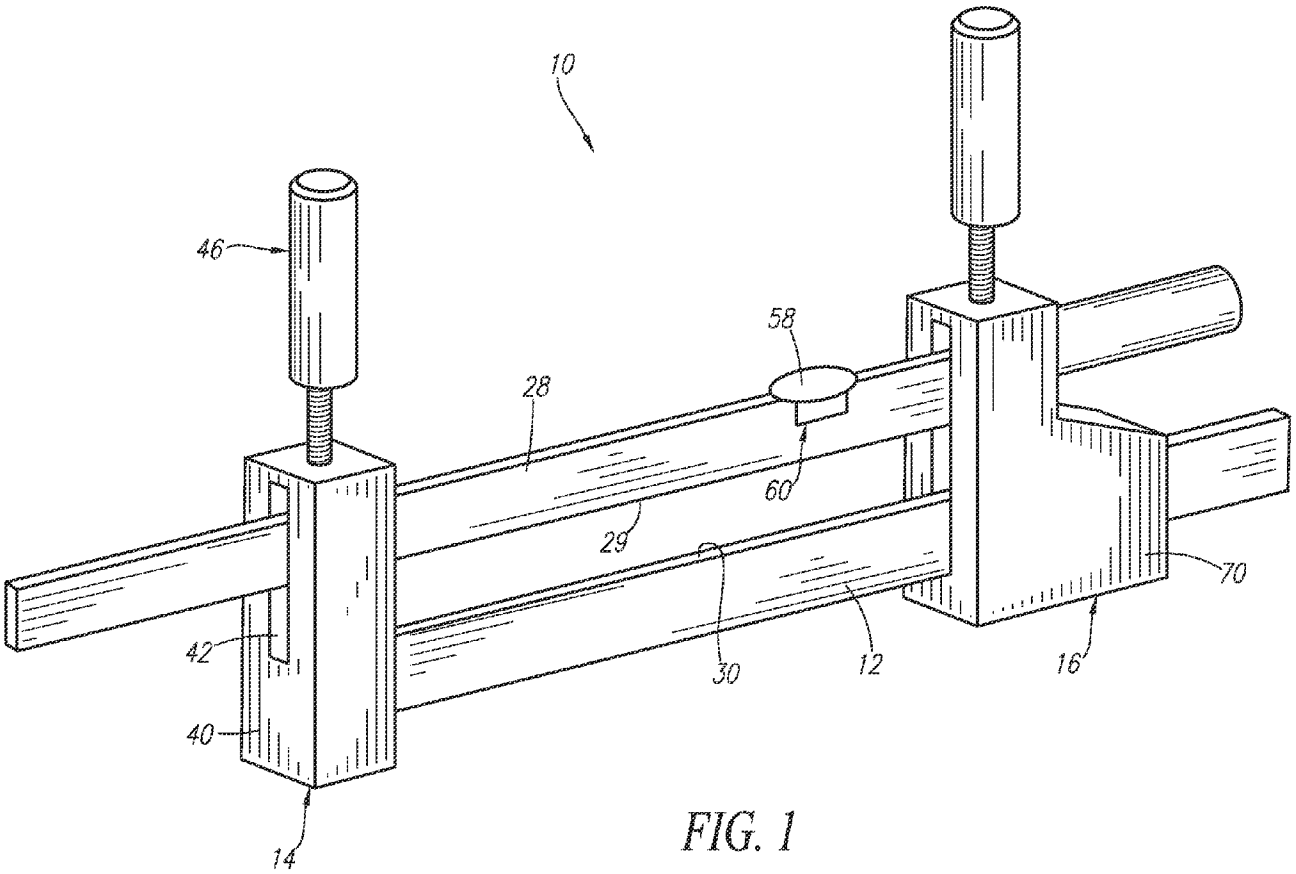
FIG. 1 is a perspective view of an illustrative embodiment of a clamp including a caul and a biasing mechanism for urging the caul toward a rail.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1 shows a side view of an illustrative embodiment of a clamp 10 according to the present technology. As shown, the clamp 10 includes a rail 12 that defines a range of longitudinal adjustment of at least one of, and optionally both of two clamping jaws 14, 16 between which a plurality of edge-aligned objects are to be clamped together in a side-by-side arrangement. An adjustable caul 28 extends between the clamping jaws 14, 16 and exerts a compressive force on the tops of the edge-aligned objects disposed between the caul 28 and the rail 12, to maintain a substantially linear arrangement of those edge-aligned objects.

Figure 2:
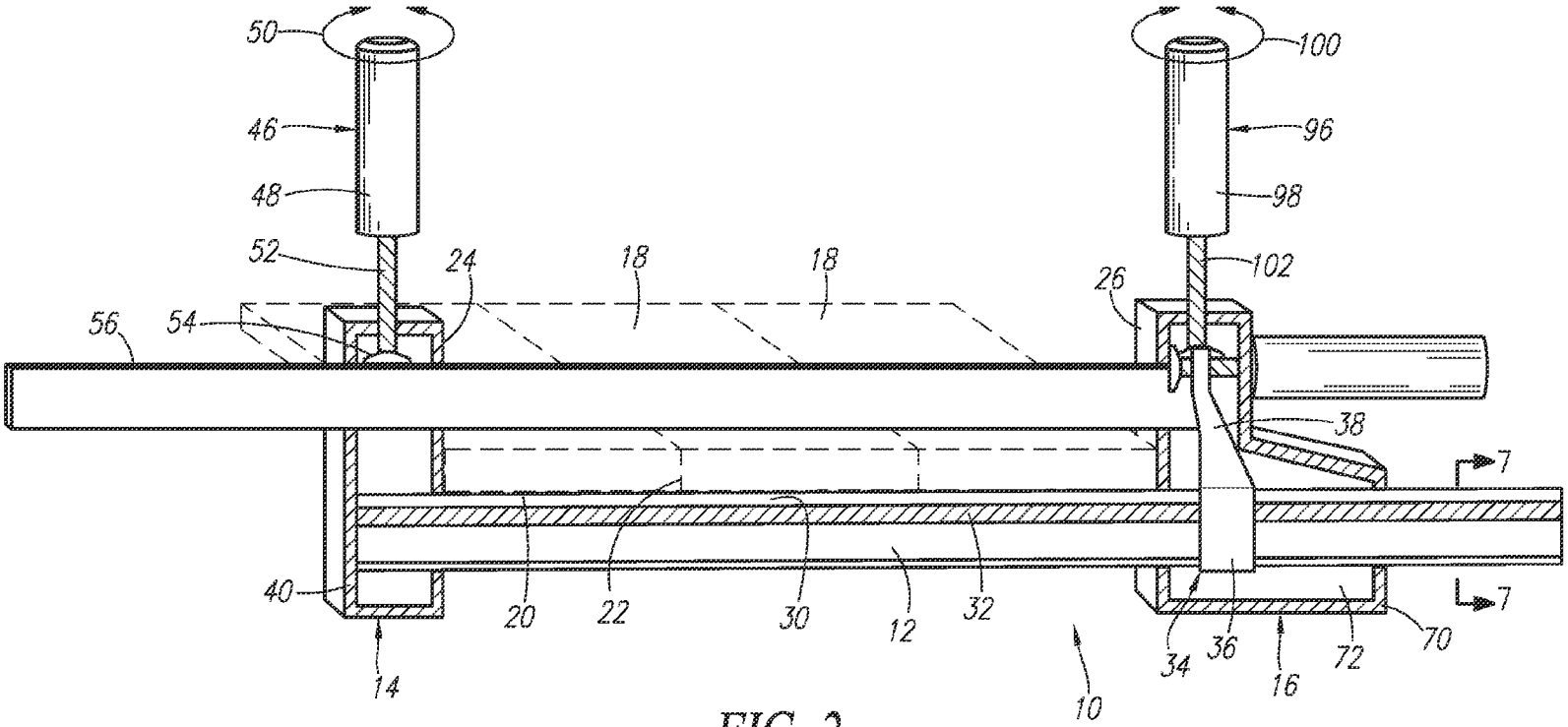
FIG. 2 is a side, partially cutaway view of the clamp in FIG. 1 with a plurality of edge-aligned boards clamped between opposing clamping jaws and between a rail and a caul.
Figure 3:
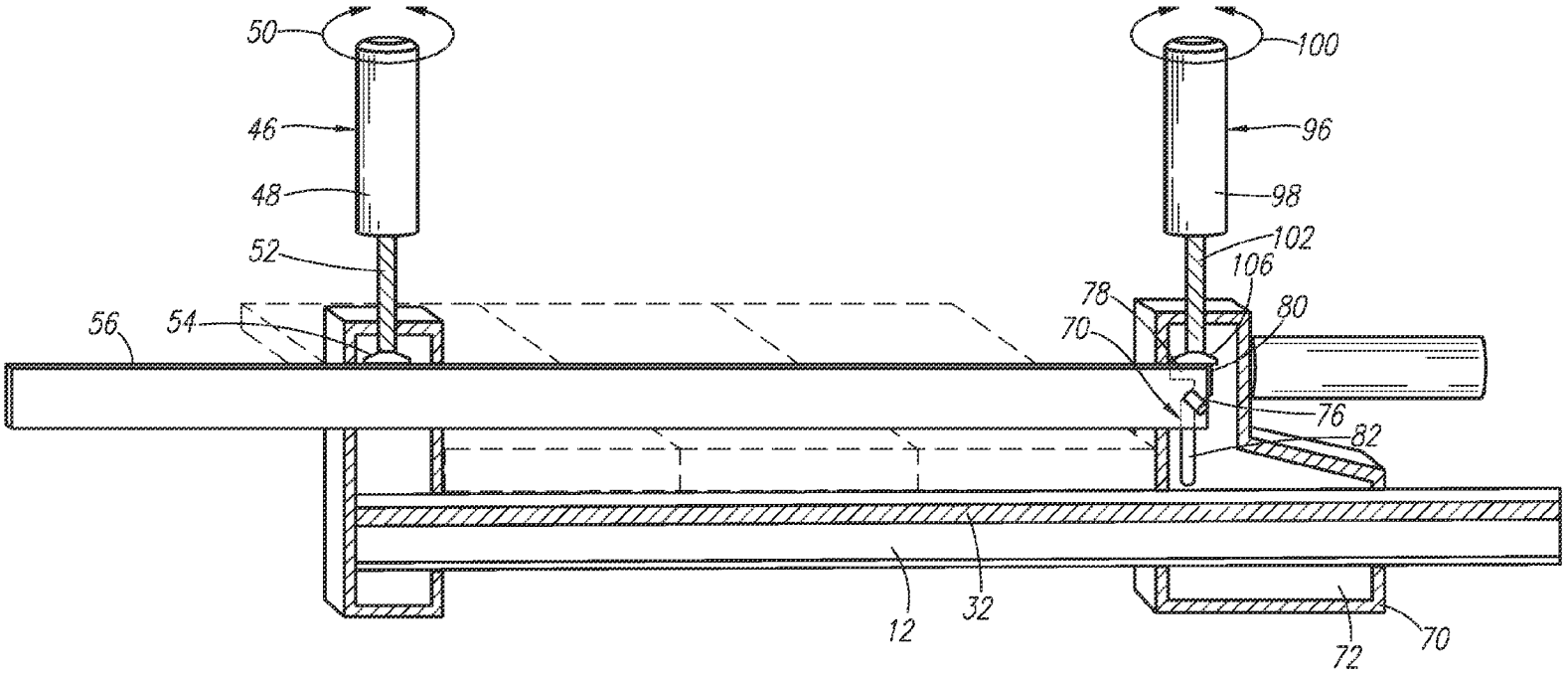
FIG. 3 is a side, partially cutaway view of the clamp in FIG. 2, with a portion of a clamping mechanism within a housing of an adjustable jaw removed to expose a caul end and associated biasing mechanism.

The illustrative embodiments of the clamp 10 will be described herein as clamping a plurality of edge-aligned wooden planks 18 as the objects, as shown in FIGS. 2 and 3, being glued together to collectively form a larger wooden panel. However, the present disclosure is not so limited, and edge-aligned objects other than wooden planks can similarly be clamped together between the clamping jaws 14, 16 as described herein. Being edge-aligned in the illustrative embodiments, the planks 18 in FIGS. 2 and 3 are arranged such that a major planar surface 20 of each plank 18 abuts against a working surface 30 of the rail 12, and the planks 18 are urged toward the working surface 30 of the rail 12 by the caul 28. A minor planar surface 22, which can optionally have a length that is shorter than a length of the major planar surface 20, of each plank 18 is abutted against either the minor planar surface 22 of a contiguous plank 18 or a face 24, 26 of one of the clamping jaws 14, 16, respectively. A glue or other adhesive can be provided between the abutting minor planar surfaces 22 of contiguous planks 18 to dry or cure while the planks 18 are subjected to the compressive force exerted thereon by the clamping jaws 14, 16, and to the compressive force exerted thereon by the caul 28 and the rail 12.

The rail 12 includes at least one, and optionally a plurality of track regions 32 that allows at least one of the jaws 14, 16 to be adjusted to a desired location along the length of the rail 12, yet cooperates with a compatible feature of a clamping mechanism 34 provided to the jaw(s) 14, 16 to maintain the jaw(s) 14, 16 at the desired location(s). For example, the embodiment of the rail 12 shown in FIG. 2 includes a track region 32 including a row of serrations that are linearly arranged along the length of the rail 12. The trough between sequential serrations receives compatible teeth provided to an interior of a sleeve 36 that supports a locking arm 38 of the clamping mechanism 34. The teeth and serrations can be configured to allow the jaw 16 to be manually slid, by hand, along the track region 32 to the desired location within close proximity to the minor planar surface 22 of the plank 18 nearest the jaw 16. At that desired location the angle and/or position of the jaw 16 can be adjusted relative to the rail 12 to allow the teeth to engage the serrations. Adjusting the clamping mechanism 34 as described below to exert the compressive force on the planks 18 between the jaws 14, 16 can interfere with removal of the teeth from the serrations until the compressive force is released, or at least lowered to a point that allows the teeth to travel over the serrations.

Figure 7:
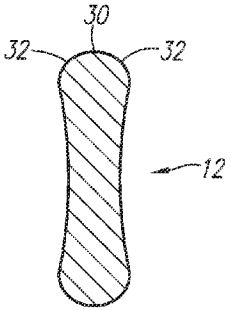
FIG. 7 shows a sectional view of an embodiment of the rail taken along line 7-7 in FIG. 2, the rail comprising a longitudinally-extending track region on opposite lateral sides.

For the embodiment shown in FIG. 2, the rail 12 includes two track regions 32, arranged to extend longitudinally along opposite lateral sides of the rail 12, as represented by the flats shown in the sectional view of FIG. 7. Such an arrangement allows the working surface 30 of the rail 12 to be devoid of serrations or other machined surfaces that could mar the major planar surface 20 of the planks 18 that come into contact with the working surface 30. According to alternate embodiments, the working surface 30 and/or a working surface 29 (FIG. 1) of the caul that contacts the planks 18 can optionally be provided with an elastically-compressible material such as a natural or synthetic rubber-like material to further protect the major planar surfaces 20 of the planks 18 from damage when the clamp 10 is used as described herein.

Figure 5:
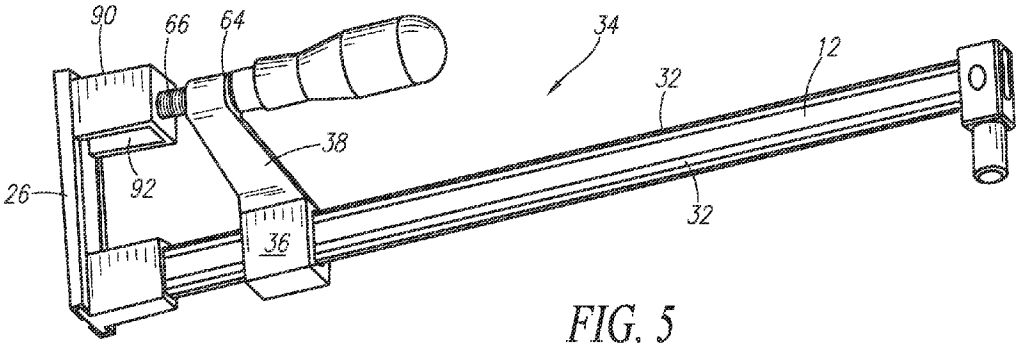
FIG. 5 is a perspective view of a clamping mechanism with a split cam defining an aperture through which a portion of a biasing mechanism is to extend to exert a force on a caul and urge the caul generally toward a rail.
Figure 8:
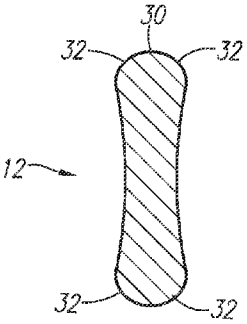
FIG. 8 shows a sectional view of an alternate embodiment of the rail comprising four longitudinally-extending track regions, two on each opposite lateral side of the rail.

An alternate embodiment of the track regions 32 is schematically illustrated in FIGS. 5 and 8. Again represented as flats in FIG. 8, two longitudinally-extending track regions 32 are formed along the length of each lateral side of the rail 12. Like the embodiment shown in FIG. 7, the working surface 30 protrudes upwardly beyond the upper extent of each of the track regions 32 arranged toward the top of the rail 12 as viewed in FIG. 8. The working surface 30 can again be devoid of serrations and smooth, and can optionally include an elastically-compressible material to make contact with, and support the planks 18 using a non-marring surface 30 to minimize damage to the planks 18 as a result of the forces exerted on the planks 18 by the working surface 30 as described herein. Regardless of the quantity and arrangement of the track regions 32 on the rail 12, the interlocking feature such as the teeth described above, for example, that is to cooperate with the serrations or other structure of the rail 12 are compatibly configured and arranged within the sleeve 36 (FIGS. 2 and 5) to maintain the position of the sleeve 36 at a desired location along the rail 12.

The jaw 14 can optionally be disposed at a fixed location at the end of the rail 12, and can be permanently affixed adjacent to the end of the rail 12 to prevent removal of the jaw 14 without damaging the clamp 10. According to alternate embodiments, the jaw 14 can optionally be made adjustable along the length of the rail 12 in a manner similar to that of the other clamping jaw 16, and can optionally be removable to allow repeated removal of the jaw 14 from the rail 12 and reinstallation of the jaw 14 onto the rail 12 without damaging the clamp 10. Regardless of whether the jaw 14 is adjustable or fixed, the jaw 14 can act as a stationary surface (once positioned for adjustable embodiments of the jaw 14) against which the planks 18 can be compressed as a result of the compressive force exerted through adjustment of the other jaw 16.

Figure 9:
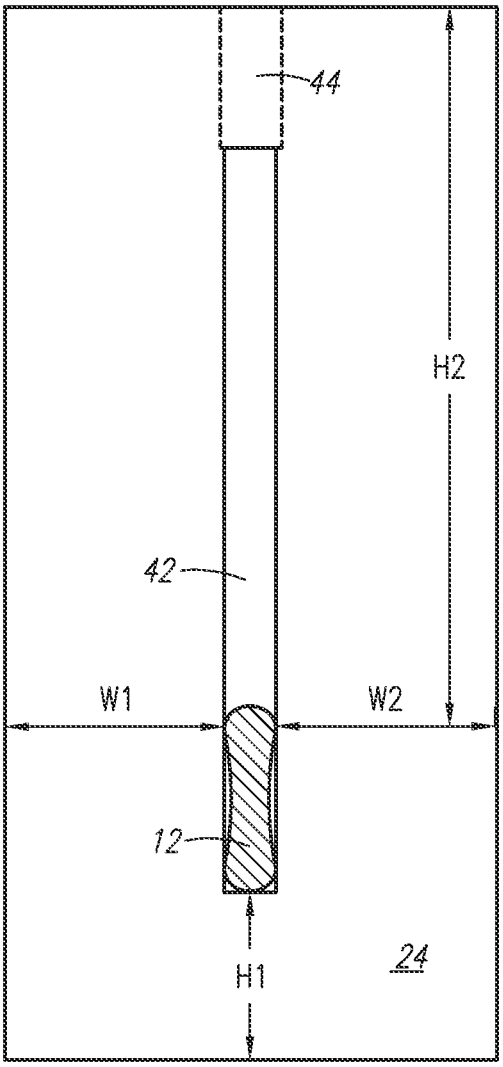
FIG. 9 shows a front view of a face side of a clamping jaw housing.

The jaw 14 includes a housing 40, shown partially cutaway in FIG. 2, that the rail 12 extends at least partially into. The jaw includes a rectangular face 24 against which the planks 18 can be compressed. The dimensions of the face 24 are suitable to establish a minimum clamping surface beyond the location of the rail 12 on all four sides. For example, as shown in FIG. 9, the face 24 can extend at least a distance denoted by W1 and W2 from each lateral side of the rail 12. The value of W1 and W2 can each be independently selected to be at least one half (0.5 in.) of an inch, at least three-quarters (0.75 in.) of an inch, at least one (1 in.) inch, at least one and one quarter (1.25 in.) inches, etc. . . . Similarly, the face 24 can extend at least a distance H1 below the rail 12, and the value of H1 can be independently selected to be at least one half (0.5 in.) of an inch, at least three-quarters (0.75 in.) of an inch, at least one (1 in.) inch, at least one and one quarter (1.25 in.) inches, etc. . . . The primary clamping region of the face 24 vertically above the rail 12 when the clamp 10 is oriented upright as shown in FIGS. 1-3 and 9, can extend at least a distance H2 above the working surface 30 of the rail 12. The value of H2 can be independently selected to be at least two (2 in.) inches, at least two and a half (2.5 in.) inches, at least three (3 in.) inches, etc. . . .

As shown in FIG. 9, the face 24 includes a substantially planar outwardly-exposed surface defining an elongated vertical aperture 42. One or more, and optionally all of the regions surrounding the aperture 24 can optionally be provided with a compressible, and optionally removable and replaceable material to cushion abutting planks 18. The aperture 42 can optionally extend entirely through the housing 40 to allow a portion of the caul 28 that is not in use to maintain alignment of the planks 18 between the caul 28 and the rail 12 to extend through the housing 40.

An aperture leading into an internal passage 44, shown as hidden lines in FIG. 9, is also formed in the top of the housing 40. The internal passage 44 can extend to the aperture 42, allowing a biasing mechanism 46 (FIGS. 1-3) to be adjusted to varying extents into the aperture 42 and impart a force that urges the caul 28 toward the rail 12 to compress the plurality of planks 18 between the caul 28 and the working surface 30 of the rail 12. For the illustrative embodiments in FIGS. 1-3, the biasing mechanism includes a handle 48 that can be rotated about a vertical axis in the directions of arrows 50. Rotation of the handle 48 causes an externally-threaded spindle 52 to rotate while cooperating with internal threading provided to the internal passage 44 extending into the housing 40. Rotation of the handle 48 in a first angular direction causes the cooperating threads to insert the spindle 52 into the aperture 42 from above, thereby causing the distal end 54 (FIGS. 2 and 3) of the spindle 52 to contact the top surface 56 of the caul 28 and urge the caul 28 in a downward direction within the aperture 42 toward the working surface 30 of the rail 12.

Figure 10:
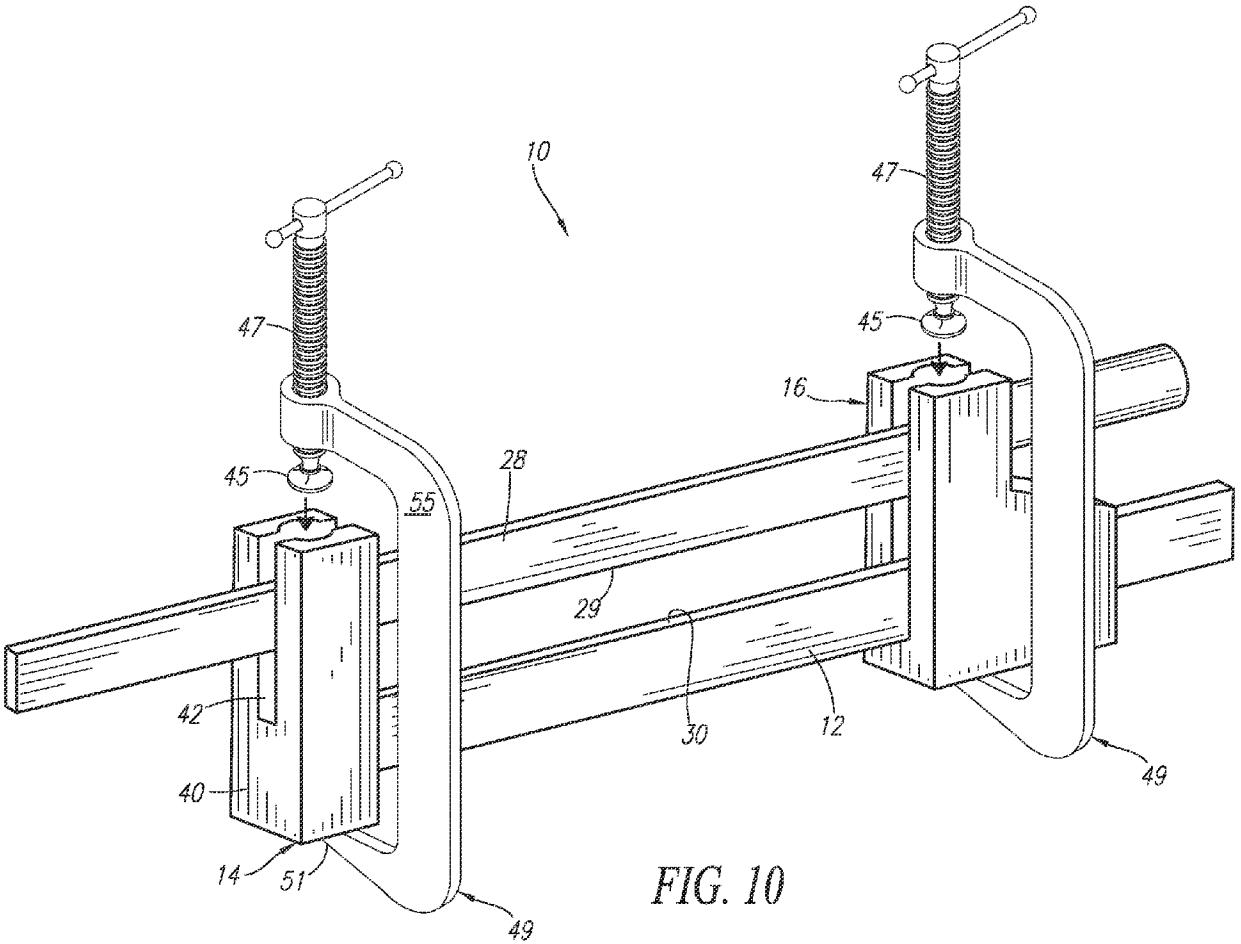
FIG. 10 is a perspective view of an illustrative embodiment of a clamp including a caul that utilizes a separable clamp that is repeatedly removable and replaceable as a biasing mechanism for urging the caul toward a rail.

The above embodiment of the biasing mechanism 46 is built into the jaw 14, forming part of an integrated assembly. According to an alternate embodiment, the internal passage 44 can have suitable dimensions to receive a portion of a separate biasing mechanism that imparts a force urging the caul 28 toward the rail 12. For example, the internal passage 44 can have a sufficiently-large diameter to receive a foot 45 (FIG. 10) provided adjacent to an end of an adjustable member 47 of a C-clamp 49, which is separable from, and optionally usable as a C-clamp independently of the clamp 10. With the stationary foot 51 of the C-clamp 49 under the housing 40, the adjustable member 47, which is shown as an externally-threaded member in FIG. 10, can be rotated or otherwise adjusted to lower the foot 45 from the body 55 of the C-clamp 49 into the internal passage 44 and push the caul 28 in a direction within the aperture 42 toward the rail 12. For such an embodiment, the circular internal passage 44 extends a suitable distance along the aperture 42 to allow the foot 45 of the C-clamp 49 to urge the caul 28 along its full range of vertical travel through the aperture 42 towards the rail 12. Similar to the previous embodiment, the aperture 42 defines a guide that establishes a permissible path along which the caul 28 can travel in response to adjustment of the biasing mechanism 46. Radially outward from the perimeter of the circular internal passage 44, the aperture 42 maintains its rectangular cross-sectional shape described with reference to FIG. 9 to guide the caul 28 as it travels toward and away from the rail 12.

According to yet another embodiment, the housing 40 can optionally lack the internal passage 44, but the rail 12 and/or the caul 28 can include a clamping region 58 (FIG. 1), which can optionally be formed as part of an adjustable protective member 60 that can be clipped onto, and optionally removed from, the rail 12 and/or caul 28. Thus, the protective member 60 can be slid or otherwise adjusted along the length of the rail 12 and/or caul 28 to allow for adjustment of the distance separating the jaws 14, 16 and remain there between. Similar to the previous embodiment, a C-clamp or other suitable clamping device can be applied to exert a compressive force on the clamping region 58 that urges the caul 28 toward the rail 12. According to alternate embodiments, the external surfaces (e.g., surfaces opposite the surfaces that come into contact with the planks 18) of the caul 28 and/or rail 12 can be formed with sufficient durability to withstand the forces exerted by the C-clamp or other clamping device, rendering the substantial portions, or even the entire extent of such surfaces between the jaws 14, 16 suitable for use as the clamping region 58.

The other clamping jaw 16 that is adjustable along the track region(s) 32 of the rail 12 can be maintained at a desired clamping location along the length of the rail 12 to oppose the clamping jaw 14 as described above. A housing 70 made of plastic or other suitably-durable material defines a generally "L" shaped internal cavity 72 (FIG. 2-4) through which at least a portion of the rail 12 travels during adjustment of the position of the jaw 16 along the track region(s) 32. As shown in FIG. 3, the housing 70 includes a channel 74 defining a path along which a peg 76 protruding from one or both lateral sides of the caul 28 can travel. The channel 74 can include a horizontal region 78 that limits the peg 76 to traveling in horizontal directions into and out of the housing 70 during installation and removal of the caul 28, respectively. Upon reaching an inward insertion limit 80, the caul 28 can be adjusted to allow the peg 76 to continue in both forward and downward directions into a vertically-oriented region 82 where the peg 76, and accordingly the caul 28, can be adjusted in directions toward and away from the rail 12 along the vertically-oriented region 82. The communication between the peg 76 and the tortuous channel 74 acts as a security feature that interferes with accidental removal of the caul 28 from the housing 70, yet allows a user to intentionally remove the caul 28 to permit usage of the clamp 10 to exert a compressive force on objects between the jaws 14, 16 without the caul 28. The vertically-oriented region 82 also allows for adjusting the separation between the caul 28 and the rail 12.

Figure 4:
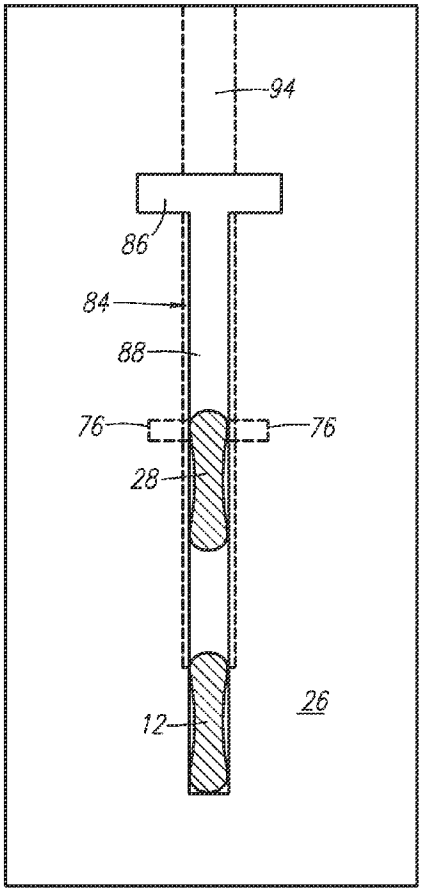
FIG. 4 shows a front view of an embodiment of a face of an adjustable jaw.

As shown in FIG. 4, an embodiment of the face 26 of the housing 70 can include a generally "T" shaped aperture 84 into which the rail 12 and the end of the caul 28 with the pegs 76 are received. To insert the caul 28 and secure it to the housing 70, the peg 76 extending from each lateral side of the caul 28 is aligned with a transverse region 86 of the aperture 84 and the caul 28 urged toward the internal cavity 72 (FIG. 3) of the housing 70 until the pegs 76 reaches the insertion limit 80. The inserted end of the caul 28 is then adjusted both downward and outward, away from the housing 70, to position the pegs 76 within the vertically-oriented region 82, which is aligned with the upright region 88 (FIG. 4) of the aperture 84. In addition to, or in lieu of the channel 74, the lateral dimensions of the upright region 88 can be insufficient to allow the pegs 76 to be removed from the face 26 through the upright region 88, thereby interfering with accidental removal of the caul 28 while the end of the caul 28 with the pegs 76 is located within the upright region. Accordingly, the housing 70 can optionally retain or otherwise be coupled to the caul 28 in a manner that minimizes the likelihood of inadvertent separation through the use of the aperture 84 formed in the face 26, alone and without the channel 74, or optionally in addition to the channel 74, which acts as a guide for the motion of the caul 28 toward and away from the rail 12. Coupled to the housing 70 in this manner, the caul 28 can be adjusted toward and away from the rail 12, and travels longitudinally along the length of the rail 12 with the housing 70. The other end of the caul 28, opposite the end with the adjacent peg(s) 76, can pass through the aperture 42 formed in the jaw 14 to extend beyond the jaw 14 to a variable extent as the jaw 16 is adjusted along the rail 12. The face 24, 26 of at least one, and optionally both of the jaws 14, 16 can optionally include a compressible material that is removable, and optionally replaceable to minimize marring of the minor planar surface 22 abutting against such jaw(s) 14, 16. At least one of the jaws 14, 16 is also adjustable along the length of the rail 12, and the rail 12 is to extend longitudinally beyond at least one of the jaws 14, 16. For such embodiments, the length of the caul 28 can be at least as long as, or approximately the same as the length of the rail 12 to allow the caul 28 to be used along the full adjustable length of the jaw(s) 14, 16 along the rail 12.

Once the jaw 16 has engaged the track region(s) 32 at the desired location adjacent to the planks 18, a clamping mechanism 34 (FIGS. 2 and 5) is manually operable by a user to urge the face 26 of the jaw 16 toward the opposing jaw 14 and impart a compressive force on the plurality of planks 18 there between. The force generated by the clamping mechanism 34 can optionally urge the face 26, independently of the rest of the housing 70, toward the opposing jaw 14 according to embodiments where the face 26 is adjustable relative to the housing 70 (e.g., the face 26 is formed as an independent member, separate from the other portion of the housing 70). According to alternate embodiments, the face 26 can be integrally formed as a monolithic structure with the other portions of the housing 70, and the force generated by the clamping mechanism can urge the face 26 as part of the housing 70 as a whole, toward the opposing jaw 14.

Similar to the jaw 14 described above, a biasing mechanism 96 (FIGS. 1-3) can be adjusted to protrude to varying extents into an internal passage 94 (shown by hidden lines in FIG. 4) in the internal cavity 72 and impart a force that urges the caul 28 toward the rail 12. For the illustrative embodiments in FIGS. 1-3, the biasing mechanism includes a handle 98 that can be rotated about a vertical axis in the directions of arrows 100. Rotation of the handle 98 causes an externally-threaded spindle 102 to rotate while cooperating with internal threading provided to the internal passage 94 extending into the housing 70. Rotation of the handle 98 in a first angular direction causes the cooperating threads to advance the spindle 102 into the internal passage 94, thereby causing the distal end 106 (FIGS. 2 and 3) of the spindle 102 to contact the top surface 56 of the caul 28 and urge the caul 28 in a downward direction, guided by the pegs 76 in the vertically-oriented region 82 of the channel 74 (FIG. 3), toward the working surface 30 of the rail 12. A portion of the clamping mechanism 34 disposed within the housing 70 has been removed from FIG. 3 for the sake of clearly illustrating communication between the biasing mechanism 96 and the caul 28.

The above embodiment of the biasing mechanism 96 is built into the jaw 16, forming part of an integrated assembly. According to an alternate embodiment, the internal passage 94 can have suitable dimensions to receive a portion of a separate biasing mechanism that imparts a force urging the caul 28 toward the rail 12. For example, the internal passage 94 can have a sufficiently-large diameter to receive a foot provided adjacent to an end of an adjustable member of a C-clamp. With the stationary foot of the C-clamp under the housing 70, the adjustable member can be rotated or otherwise adjusted to lower the foot coupled to the adjustable member and push the caul 28 in a direction dictated by communication of the pegs 76 within the vertically-oriented region 82 of the channel 74 toward the rail 12. Similar to the previous embodiment, the upright region 88 (FIG. 4) of the aperture 84 can optionally define a guide that establishes a permissible path along which the caul 28 can travel in response to adjustment of the biasing mechanism 96.

According to yet another embodiment, the housing 70 can optionally lack the internal passage 94, but the rail 12 and/or the caul 28 can include a clamping region 58 (FIG. 1), which can optionally be formed as part of an adjustable protective member 60 that can be clipped onto, and optionally removed from, the rail 12 and/or caul 28. Thus, the protective member 60 can be slid or otherwise adjusted along the length of the rail 12 and/or caul 28 to allow for adjustment of the distance separating the jaws 14, 16 and remain there between. Similar to the previous embodiment, a C-clamp or other suitable clamping device can be applied to exert a compressive force on the clamping region 58 that urges the caul 28 toward the rail 12. According to alternate embodiments, the external surfaces (e.g., surfaces opposite the surfaces that come into contact with the planks 18) of the caul 28 and/or rail 12 can be formed with sufficient durability to withstand the forces exerted by the C-clamp or other clamping device, rendering the substantial portions, or even the entire extent of such surfaces between the jaws 14, 16 suitable for use as the clamping region 58.

As shown in FIGS. 2 and 5, the sleeve 36 through which the rail 12 passes is disposed within the housing 70, and is longitudinally adjusted along the track region(s) 32 of the rail 12 to the desired clamping position immediately adjacent to the planks 18. The position and/or orientation of the sleeve 36 is adjusted relative to the rail 12 such that teeth provided to the sleeve 36 engage serrations of the track region(s) 32 (or other cooperating structures) maintain the jaw 16 in place. An internally-threaded passage 64 is supported adjacent to a distal end of the locking arm 38, and receives an externally-threaded member 66 that is rotated as a result of rotation of a handle 68. Rotation of the handle 68 in a first angular direction about a central longitudinal axis of the threaded member 66 causes the threaded member 66 to advance from the passage 64 toward the opposing jaw 14, while rotation of the handle 68 in the opposite angular direction causes the threaded member 66 to retreat from the passage 64 in a direction away from the opposing jaw 14.

Movement of the threaded member 66 relative to the locking arm 38 is conveyed to the face 26, and optionally the housing 70 if the face 26 is formed as a monolithic unit as part of the housing 70, by a split cam 90, shown in FIG. 5. The split cam 90 extends between the threaded member 66 and the face 26. The split cam 90 is a metallic structure or structure made of another suitably-durable material that defines an aperture 92 through which a portion of the biasing mechanism 96 such as the threaded spindle 102, for example, extends to exert a force on the caul 28 and urge the caul 28 generally toward the rail 12. The depth of the aperture 92 in a longitudinal direction parallel with the longitudinal axis of the rail 12, is suitable to allow for a full range of adjustment of the face 26 toward the opposite jaw 14 to apply a suitable clamping force for edge gluing the planks 18 together. Examples of suitable compressive forces to be exerted between the jaws 14, 16 through adjustment of the clamping mechanism 34 include, but are not limited to at least 600 lbs. of clamping force, at least 800 lbs. of clamping force, at least 1,000 lbs. of clamping force, and at least 1,500 lbs. of clamping force.

Figure 6:
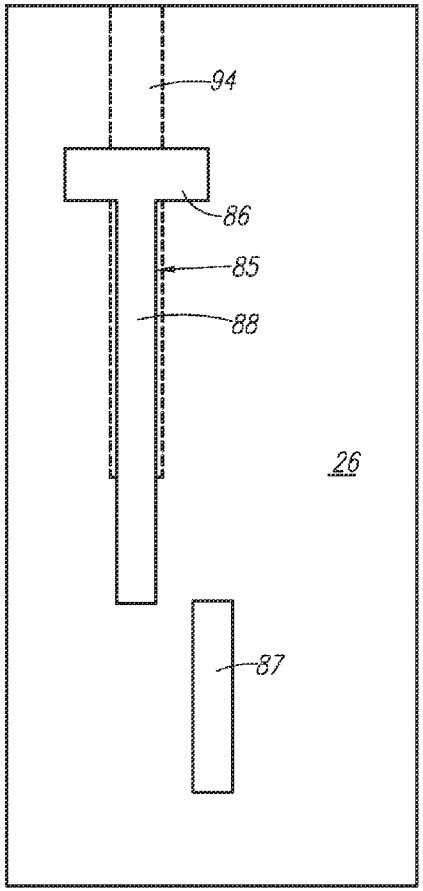
FIG. 6 shows a front view of another embodiment of a face of an adjustable jaw.

The embodiment of the aperture 84 described above includes an upright region 88 that receives both the rail 12 and the caul 28. Such an aperture 84 defines a continuous, linear path along which the caul 28 can travel between an upper limit adjacent the transverse region 86 and a lower limit where a portion of the working surface 29 of the caul 28 can contact a portion of the working surface 30 of the rail 12. The caul 28 of such an embodiment is aligned with a central region of the housing 70, approximately midway between lateral sides of the housing 70, where the threaded member 66 of the biasing mechanism 34 is positioned to impart a force on a laterally-centralized region of the face 26 and urge the face 26 toward the other jaw 14. Accordingly, the split cam 90 basically straddles the spindle 102 (FIGS. 2 and 3) or other structure that is adjusted vertically relative to the housing 70 to urge the caul 28 toward the rail 12. However, to avoid centrally locating the spindle 102 or other structure that urges the caul 28 toward the rail 12, an alternate embodiment of the aperture 85, shown in FIG. 6, can be laterally offset from an aperture 87 formed in the face 26 that receives the rail 12. According to such an embodiment, the internal passage 94 can also be laterally offset from the aperture 87. Thus, the threaded member 66 of the clamping mechanism can be centrally located within the housing 70 to urge the face 26 toward the opposite jaw 14 without interfering with vertical adjustment of the offset spindle 102 or other structure to urge the caul 28 toward the rail 12. Instead, the threaded member 66 can advance from and retreat into the passage 64 (FIG. 5) along an axis that is next to the axis along which the spindle 102 or other structure travels according to the present embodiment. However, for the sake of brevity and clarity, use of the caul 28 within the aperture 84 appearing in FIG. 4 will be described below.

The rail 12 can include a substantially hourglass cross section such as that shown in FIGS. 7 and 8, in which a top region of the rail 12 adjacent the working surface 30 and a bottom region of the rail 12 have a greater width than a midsection of the rail 12. According to alternate embodiments, the rail 12 can have a cross section with a substantially "I" shape, similar to the cross section of an I-beam, or any other suitable cross-sectional shape and dimensions to provide the rail 12 with suitable strength to resist deflecting beyond a suitable extent when subjected to the clamping forces discussed herein. For example, the rail 12 can be of suitable size and/or shape to deflect, at any location between the jaws 14, 16, no more than two hundredths (0.02 in.) of an inch, no more than one hundredths (0.01 in.) of an inch, and/or no more than five thousandths (0.005 in.) of an inch when a compressive force of at least one thousand (1,000 lbs.), or even at least one thousand five hundred (1,500 lbs.) is applied to the plurality of edge-aligned objects by the first and second clamping jaws 14, 16.

Similarly, the caul 28 can be formed as an elongate bar with a substantially-rectangular cross section, as shown in the drawings, to minimize the width of the aperture 42 required to be defined by the face 24 of the jaw 14 to allow the caul 28 to extend there through. However, alternate embodiments of the caul 28 can have any desired cross-sectional shape suitable to resist deflection to maintain the major planar surface 20 of each plank 18 clamped between the jaws 14, 16 against the working surface 30. For example, the caul 28 can have a circular or other arcuate cross sectional shape without departing from the scope of the present disclosure. Further, the working surface 29 of the caul 28 can optionally be cambered, including a downward-arching (e.g., concave up, with apex toward rail 12) arcuate region between the two opposite longitudinal ends of the caul 28.

In use, the clamp 10 can be prepared by separating the jaws 14, 16 a sufficient distance to receive each of the planks 18 edge aligned, with the minor planar surface 22 of one plank 18 abutting against the minor planar surface 22 of an immediately adjacent plank 18. The caul 28 is also separated from the working surface 30 of the rail 12 a suitable distance that is greater than the dimension of the planks 18 between the opposite major planar surfaces 20. The glue or other adhesive can be applied between such opposing minor planar surfaces 22 before or after the planks 18 are arranged between the jaws 14, 16. Once the planks 18 are disposed between the jaws 14, 16 and between the caul 28 and the rail 12, at least one, and optionally both of the jaws 14, 16 are roughly positioned along the rail 12 to be located within close proximity to, and optionally in contact with the outward-exposed minor planar surfaces 22 of the outermost planks 18. The jaw(s) 14, 16 that is/are adjusted can be quickly repositioned by hand along the length of the rail 12 by adjusting the position and/or orientation of the one or more movable jaw(s) to disengage the cooperating features (e.g., serrations along the track region(s) 32 and compatible teeth within the sleeve 36 (FIG. 5)) and sliding the one or more movable jaw(s) 14, 16 along the rail 12. Once the desired jaw spacing has been roughly established, the adjusted jaw(s) is/are again repositioned and/or reoriented to cause the cooperating features to be loosely engaged, thereby establishing the clamping position(s) of the jaw(s) 14, 16 adjacent to the edge-aligned planks 18.

At this time, the biasing mechanism 96 can be manipulated by the user to urge the caul 28 toward the rail 12, thereby securely holding the planks 18 in their edge-aligned positions between the caul 28 and rail 12. The biasing mechanism 96 can be manipulated by rotating the handle 98 as described above, by adjusting the separate C-clamp, or otherwise applying a force on the caul 28 to clamp the edge-aligned planks 18 between the caul 28 and the rail 12. With the cooperating features loosely engaged, the clamping mechanism 34 is manipulated by the user through rotation of the handle 68 in a first angular direction to advance the threaded member 66 from the passage 64 toward the opposing jaw 14. This urges the split cam 90 straddling the spindle 102, and accordingly the face 26, toward the opposite jaw 14. The reactive force exerted by the edge-aligned planks 18 opposing further adjustment of the jaws 14, 16 toward each other causes the cooperating features to become firmly engaged to lock the jaws 14, 16 in place along the rail 12. The manipulation of the clamping mechanism 94 also applies the compressive force on the planks 18 between the jaws 14, 16 to hold the planks 18 firmly in place while the glue or other adhesive dries, cures, or otherwise joins the planks 18. The force exerted on the planks between the caul 28 and the rail 12 interferes with the ability of the planks 18 to bow under the pressure between the jaws 14, 16.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A clamp comprising:

a rail comprising a track region;

a first clamping jaw that is to be maintained at a first clamping location along a length of the rail while a plurality of edge-aligned objects are clamped together;

a second clamping jaw that is adjustable along the track region of the rail and is to be maintained at a second clamping location along the length of the rail to oppose the first clamping jaw while the plurality of edge-aligned objects are clamped together between the first and second clamping jaws;

a clamping mechanism that is operable to urge a face of the second clamping jaw at the second clamping location toward the first clamping jaw to impart a compressive force on the plurality of edge-aligned objects between the first and second clamping jaws; and a caul that extends a distance between the first and second clamping jaws while positioned with a bottom edge of the caul at an elevation above the rail that is less than a height of at least one of the first and second clamping jaws to exert a compressive force on the plurality of edge-aligned objects disposed between the caul and the rail.

2. The clamp of claim 1, wherein the rail comprises:

a cross sectional shape that has a lateral dimension adjacent to at least one of a top region and a bottom region of the rail that is greater than a lateral dimension adjacent to a midsection of the rail.

3. The clamp of claim 1, wherein the track region comprises a plurality of serrations, and a top surface of the rail against which the plurality of edge-aligned objects are to be compressed between a bottom surface of the caul is devoid of the plurality of serrations.

4. The clamp of claim 3, wherein the rail comprises an angled region comprising the plurality of serrations, and the angled region extends to a location that is suitably recessed from the top surface to avoid establishing contact between the plurality of serrations and the plurality of edge-aligned objects while the plurality of edge-aligned objects are compressed between the caul and the rail.

5. The clamp of claim 3, wherein the bottom surface of the caul and the top surface of the rail each comprises a compressible protective material that protects the plurality of edge-aligned objects from damage when compressed between the caul and the rail.

6. The clamp of claim 1, wherein the rail is suitably sized to deflect no more than five thousandths (0.005 in.) of an inch when a compressive force of at least one thousand five hundred (1,500 lbs.) is applied to the plurality of edge-aligned objects by the first and second clamping jaws.

7. The clamp of claim 1, wherein at least one of the face of the second clamping jaw and a face of the first clamping jaw comprises a compressible material that is removable.

8. The clamp of claim 1, wherein at least one of the face of the second clamping jaw and a face of the first clamping jaw defines an aperture through which a portion of the caul extends while the plurality of edge-aligned objects are clamped between the caul and the rail, and between the first and second clamping jaws.

9. The clamp of claim 1 further comprising a biasing mechanism provided to at least one of the first and second clamping jaws, the biasing mechanism being adjustable to impart a force that urges the caul toward the rail to compress the plurality of edge-aligned objects between the caul and the rail.

10. The clamp of claim 9, wherein the biasing mechanism comprises a threaded member that cooperates with a threaded passageway formed as part of the at least one of the first and second clamping jaws to impart the force on the caul to urge the caul toward the rail.

11. The clamp of claim 1, wherein at least one of the first and second clamping jaws defines an aperture extending from a top surface of the at least one of the first and second clamping jaws generally toward the rail, wherein the caul is to be inserted into the aperture through the top surface of the at least one of the first and second clamping jaws to position the plurality of edge-aligned objects between the caul and the rail.

12. The claim of claim 11, wherein the aperture extending from the top surface is configured to receive another jaw of a different clamp, which is separable from the clamp, to impart a force on the caul and thereby urge the caul toward the rail to compress the plurality of edge-aligned objects between the caul and the rail.

13. The clamp of claim 1, wherein the caul extends through at least one of the first and second clamping jaws, and comprises a length that is approximately equal to a length of the rail.

14. A clamp comprising:

a rail comprising: a top surface that is to make contact with a plurality of edge-aligned objects clamped together, and a track region;

a first clamping jaw that is coupled to the rail at a first, stationary clamping location along the rail;

a second clamping jaw that is adjustable along the track region of the rail and cooperates with a set of serrations of the track region to maintain a position of the second clamping jaw at a desired location along the rail opposing the first clamping jaw on an opposite side of the plurality of edge-aligned objects;

a clamping mechanism that is operable to urge a face of the second clamping jaw at the desired location toward the first clamping jaw to impart a compressive force on the plurality of edge-aligned objects between the first and second clamping jaws;

a caul that spans an entire distance between the first and second clamping jaws; and a biasing mechanism provided to at least one of the first clamping jaw and the second clamping jaw, the biasing mechanism being operable to urge the caul toward the rail to an elevation where a bottom of the caul is located above the top surface of the rail but below a height of the first and second clamping jaws to exert a compressive force that promotes a planar arrangement of the plurality of edge-aligned objects disposed between the caul and the rail.

15. The clamp of claim 14, wherein the caul is removable from the clamp to be separated from the first and second clamping jaws.

16. The clamp of claim 14, wherein a length of the caul is at least equal to a length of the rail, and the caul extends beyond the first clamping jaw.

* * * * *